US006478401B1

(12) United States Patent
King et al.

(10) Patent No.: US 6,478,401 B1
(45) Date of Patent: Nov. 12, 2002

(54) METHOD FOR DETERMINING VERTICAL MISALIGNMENT BETWEEN PRINTER PRINT HEADS

(75) Inventors: David Golman King, Shelbyville, KY (US); Patrick Laurence Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/900,634

(22) Filed: Jul. 6, 2001

(51) Int. Cl.[7] ..... B41J 29/393; B41J 29/38
(52) U.S. Cl. ..... 347/19
(58) Field of Search ..... 347/19, 14, 12, 347/10, 9, 11, 15, 17, 23

(56) References Cited

U.S. PATENT DOCUMENTS

| | | | | |
|---|---|---|---|---|
| 4,449,052 A | | 5/1984 | Krieg | |
| 4,675,696 A | | 6/1987 | Suzuki | |
| 4,856,903 A | | 8/1989 | Kipphan et al. | |
| 4,907,013 A | | 3/1990 | Hubbard et al. | |
| 5,287,162 A | | 2/1994 | de Jong et al. | |
| 5,404,020 A | | 4/1995 | Cobbs | |
| 5,448,269 A | | 9/1995 | Beauchamp et al. | |
| 5,451,990 A | | 9/1995 | Sorenson et al. | |
| 5,530,460 A | | 6/1996 | Wehl | |
| 5,534,895 A | | 7/1996 | Lindenfelser et al. | |
| 5,552,810 A | | 9/1996 | Matsuo | |
| 5,600,350 A | | 2/1997 | Cobbs et al. | |
| 5,600,357 A | | 2/1997 | Usui et al. | |
| 5,610,639 A | | 3/1997 | Takada et al. | |
| 5,796,414 A | | 8/1998 | Sievert et al. | |
| 5,797,690 A | | 8/1998 | Iwamura et al. | |
| 5,835,108 A | | 11/1998 | Beauchamp et al. | |
| 5,898,443 A | | 4/1999 | Yoshino et al. | |
| 5,946,537 A | | 8/1999 | Nakayasu et al. | |
| 5,980,016 A | | 11/1999 | Nelson et al. | |
| 6,039,427 A | | 3/2000 | Kanome | |
| 6,045,210 A | | 4/2000 | Suzuki et al. | |
| 6,076,915 A | | 6/2000 | Gast et al. | |
| 6,082,911 A | | 7/2000 | Murakami | |
| 6,084,606 A | | 7/2000 | Moriyama | |
| 6,109,722 A | | 8/2000 | Underwood et al. | |
| 6,132,024 A | | 10/2000 | Nelson et al. | |
| 6,154,229 A | * | 11/2000 | Corrigan | 347/17 |
| 6,164,750 A | | 12/2000 | Subirada et al. | |
| 6,196,652 B1 | | 3/2001 | Subirada et al. | |
| 6,196,736 B1 | | 3/2001 | Otsuki et al. | |
| 6,198,549 B1 | | 3/2001 | Decker et al. | |
| 6,198,896 B1 | | 3/2001 | Nakayasu et al. | |

* cited by examiner

*Primary Examiner*—Craig Hallacher
*Assistant Examiner*—Charles W. Stewart, Jr.
(74) *Attorney, Agent, or Firm*—Thompson Hine, LLP

(57) ABSTRACT

A method for determining vertical misalignment between first and second print heads involves printing a test pattern of first and second alternating slanted blocks extending horizontally. The first slanted blocks are printed by the first print head and the second slanted blocks are printed by the second print head. A known edge angle of the first and second slanted blocks is substantially the same. A sensor is moved across the test pattern for evaluating misalignment.

17 Claims, 3 Drawing Sheets

METHOD FOR DETERMINING VERTICAL MISALIGNMENT BETWEEN PRINTER PRINT HEADS

TECHNICAL FIELD

The present invention relates generally to printers and, more particularly, to a method for determining vertical misalignment between print heads.

BACKGROUND OF THE INVENTION

Many printers include print heads which are mounted on a carriage for movement across a paper path during printing operations. An ideally assembled printer includes print heads which are mounted in predetermined positions so as to place the print head nozzles in predetermined desired positions. However, mechanical tolerances and manufacturing techniques rarely provided for positioning of the print heads exactly at the predetermined desired positions. Accordingly, for any given printer their will typically be both a horizontal misalignment between print heads and a vertical misalignment between print heads. Many techniques for determining horizontal and vertical misalignment between print heads are known, but simpler techniques are always more desirable.

While U.S. Pat. No. 5,796,414 discloses the printing and scanning of a diagonal test pattern, each print head prints a bunched sequence of diagonal lines and the sequences printed by the print heads do not overlap. Complex calculation techniques are used to evaluate the diagonal pattern.

Accordingly, it would be advantageous to provide a technique for determining vertical misalignment between print heads where a horizontal misalignment between the print heads is already known.

SUMMARY OF THE INVENTION

In one aspect, in a printer including first and second print heads mounted for movement across a paper path along a defined horizontal axis, a method for determining vertical misalignment between the print heads along a defined vertical axis which extends substantially perpendicular to the horizontal axis is provided. The method involves the steps of: (a) printing a test pattern of first and second alternating slanted blocks extending horizontally across a media, the first slanted blocks printed by the first print head and the second slanted blocks printed by the second print head, a known edge angle of the first and second slanted blocks being substantially the same; (b) moving a sensor horizontally over the test pattern and producing an output signal therefrom; (c) identifying edges of the first slanted blocks and the second slanted blocks based upon the sensor output signal; and (d) determining vertical misalignment of the first and second print heads based upon the edges identified in step (c), the known edge angle, and a known horizontal misalignment of the first and second print heads.

In another aspect, in a printer including first and second print heads mounted for movement across a paper path along a defined horizontal axis, a method for determining misalignment between the print heads along a defined vertical axis which extends substantially perpendicular to the horizontal axis is provided. The method involves the steps of: (a) printing a test pattern of a plurality of first slanted blocks and a plurality of second slanted blocks, the first slanted blocks and second slanted blocks alternating and extending horizontally across a media, the first slanted blocks printed by the first print head and the second slanted blocks printed by the second print head, a known edge angle of the first and second slanted blocks being substantially the same; (b) moving a sensor horizontally over the test pattern and producing an output signal therefrom; (c) obtaining sample data points of the sensor output signal at a known sampling rate as the sensor moves at a known speed; (d) calculating using the sample data points a first center of a given first slanted block, a second center of an adjacent second slanted block, and a third center of a next first slanted block; (e) calculating a horizontal offset as a function of the first, second and third centers; and (f) determining vertical misalignment of the first and second print heads based upon the calculated horizontal offset of step (e), the known edge angle, and a known horizontal misalignment of the first and second print heads.

In a further aspect, in a printer including first and second print heads mounted for movement across a paper path along a defined horizontal axis, a method for determining misalignment between the print heads along a defined vertical axis which extends substantially perpendicular to the horizontal axis is provided. The method involves the steps of: (a) printing a test pattern of a plurality of first slanted blocks and a plurality of second slanted blocks, the first slanted blocks and second slanted blocks alternating and extending horizontally, the first slanted blocks printed by the first print head and the second slanted blocks printed by the second print head, a known edge angle of the first and second slanted blocks being substantially the same; (b) moving, at a known speed, a sensor horizontally over the test pattern and producing an output signal therefrom; (c) determining vertical misalignment of the first and second print heads as a function of amplitude of the sensor output signal, the known speed, the known edge angle, and a known horizontal misalignment of the first and second print heads.

DETAILED DESCRIPTION

Figure 1:
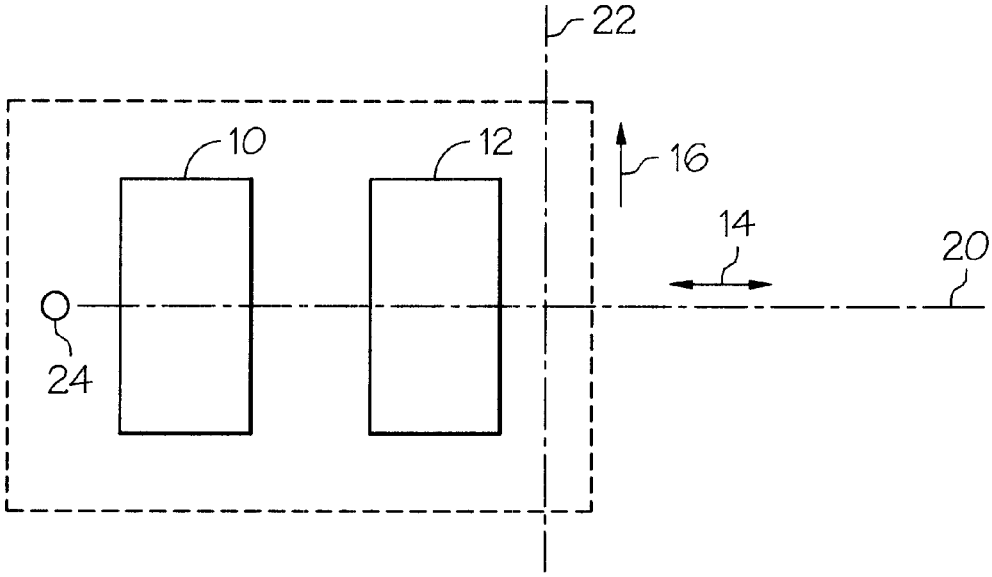
FIG. 1 is a schematic of a print head arrangement.

Referring to FIG. 1, a schematic view showing the relative positioning of a print head 10 and a print head 12 are shown, with both mounted for movement back and forth 14 across a paper path in which paper moves in direction 16. The use and construction of a print head carriage 18 for such purpose is well known. In this arrangement, a defined horizontal axis 20 aligned with the back and forth movement of the print heads is shown, and a defined vertical axis 22 that is substantially perpendicular to the horizontal axis 20 is also shown. Print head 10 may print in mono while print head 12 may print in cyan. However, the method described below is not limited to mono and cyan print heads and is not limited to determining vertical misalignment between print heads which print different colors. A sensor 24, such as a reflective light photo sensor, may also be positioned on the carriage 18 for movement horizontally across the paper path.

Figure 2:
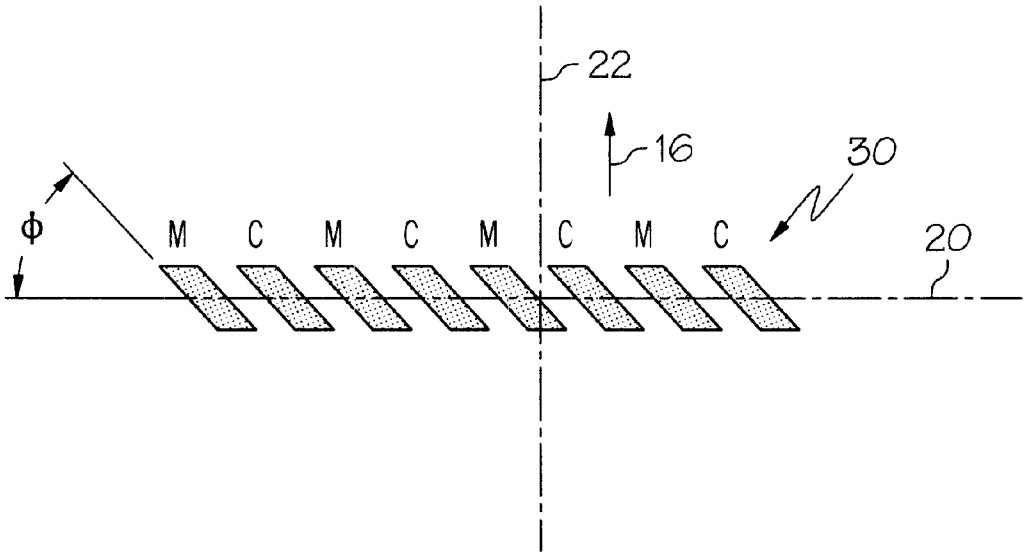
FIG. 2 depicts a printed test pattern.

A method for determining vertical misalignment between print head 10 and print head 12 is now described. Referring to FIG. 2, the method involves printing a test pattern 30 of first M and second C alternating slanted blocks extending horizontally across a media, where the blocks are slanted relative to both the horizontal axis and vertical axis as shown. The first slanted blocks M are printed by the print head 10 and the second slanted blocks C printed by the second print head 12. A known edge angle $\phi$ of the first and second slanted blocks is substantially the same. The edge angle $\phi$ may be selected as preferred and in one embodiment is 26.6°. The sensor 24 is moved horizontally over the test pattern 30 and produces an output signal 32 such as that shown in FIG. 3. When the sensor 24 is passing over a non-printed region of the pattern 30 the output signal is at maximum MAX indicating a high amount of reflected light off the pattern 30. When the sensor 24 crosses a leading edge of a first slanted block M the output signal quickly drops to a low MINM indicating a low amount of reflected light off the pattern. The output signal 32 quickly rises back to MAX when the trailing edge of each first slanted block M is crossed. Similarly, when the sensor 24 crosses a leading edge of a second slanted block C the output signal quickly drops to a low $MIN_C$ indicating a low amount of reflected light off the pattern. The low $MIN_C$ is higher than the low $MIN_M$ due to the differences between amount of light reflected by mono printing and cyan printing. The output signal 32 quickly rises back to MAX when the trailing edge of each second slanted block C is crossed. By examining the output signal 30, the edges of the first slanted blocks M and the second slanted blocks C can be determined. Vertical misalignment of the first 10 and second 12 print heads can then be determined based upon the identified edges, the known edge angle $\phi$, and a known horizontal misalignment of the first and second print heads.

Figure 3:
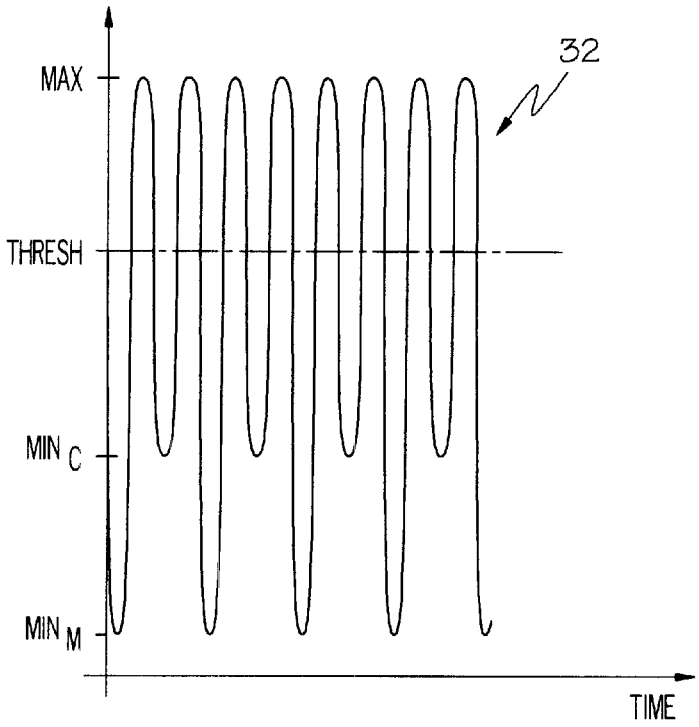
FIG. 3 shows a sensor output signal.
Figure 4:
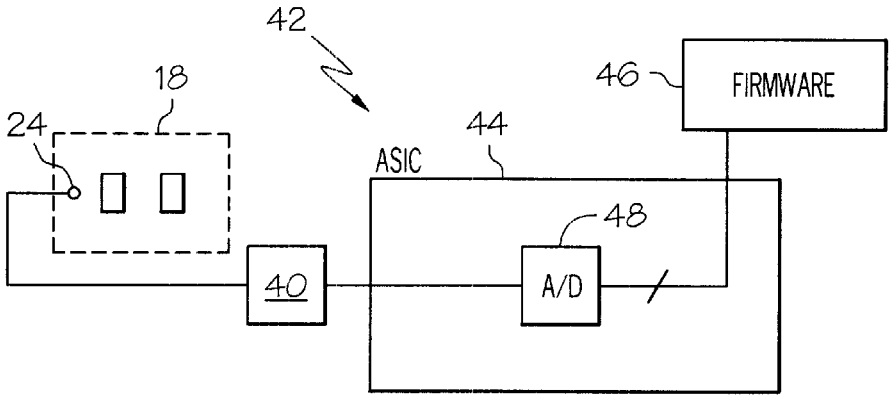
FIG. 4 is a schematic of one embodiment for sensor output signal analysis.

In one embodiment, the edges of the blocks are identified by moving the sensor 24 at a known speed over the pattern 30 and obtaining sample data points of the sensor output signal at a known sampling rate. Referring to FIG. 4, the sensor output signal may be filtered by filter 40 and passed to a controller 42 including an ASIC 44 and associated firmware 46 or other code. The ASIC includes an A/D converter 48. The firmware 46 samples the output of the A/D converter 48 and stores the sample data points in memory such as RAM. The sample data points are stored in a sequential manner such that a sequence number of each sample data point is known. The block edges are determined by comparing the sample data points to a threshold value THRESH (FIG. 3). The threshold value may be selected substantially midway between MAX and $MIN_C$ as shown, but other values could also be selected. Each transition across the threshold value represents a slanted block edge and the sequence number for the sample point where the transition occurs can be correlated to a position due to the known speed of movement of the sensor 24 and the known sampling rate.

Figure 5:
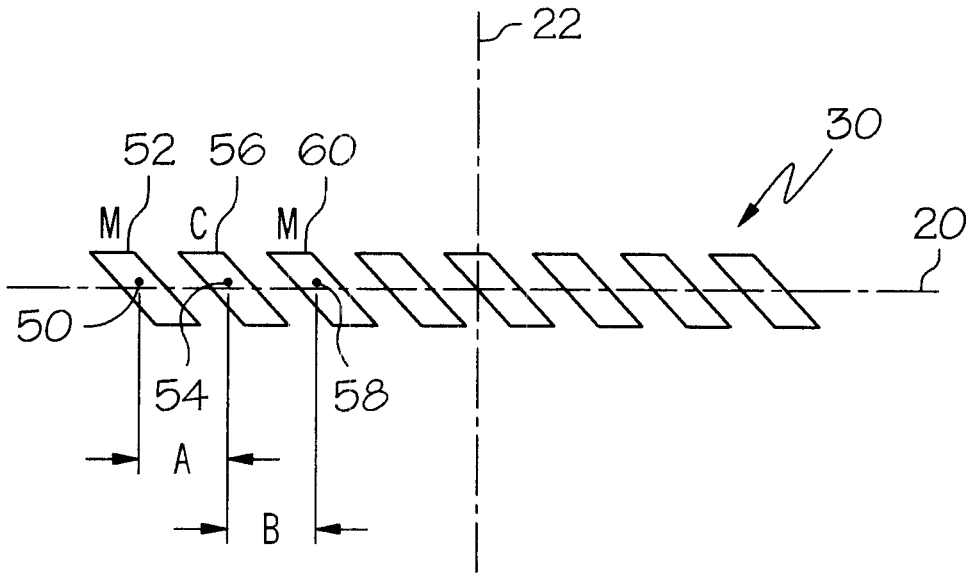
FIG. 5 is depicts a printed test pattern.

Referring to FIG. 5, once the block edges are identified a first center 50 of a given first slanted block 52, a second center 54 of an adjacent second slanted block 56, and a third center 58 of a next first slanted block 60 are calculated. The centers are calculated relative to the horizontal axis 20. For example, if the left or leading edge of block 52 occurs at position/sample point 180 and the right or trailing edge of block 52 occurs at position/sample point 220, the center is easily calculated as [(180+220)/2] or 200. A horizontal offset can be calculated as a function of the first 50, second 54 and third 58 centers. In particular, if the center 50 is determined at 200, the center 54 is determined at 290 and the center 58 is determined at 400, the offset can be calculated by subtracting center 54 from center 50 to determine distance A (90) and subtracting center 54 from center 58 to determine distance B (110). The horizontal offset is then determined as [(A–B)/2], in this example (90–110)/2 or −10.

Vertical misalignment of the first and second print heads is then determined based upon the calculated horizontal offset, the known edge angle $\phi$, and the known horizontal misalignment of the first 10 and second 12 print heads. In particular, the −10 horizontal offset represents an adjustment amount needed to properly position the center 54 of block 56 at 200 as opposed to 190. If the known horizontal misalignment is −4, then the horizontal offset attributable to vertical misalignment is the horizontal offset −10 less the horizontal misalignment −4, or −6 which is the corrected horizontal offset. Further, because the blocks are slanted, the vertical misalignment is then calculated as a function of the corrected horizontal offset and the tangent of the edge angle $\phi$. If an edge angle of 26.6° is used, the tangent gives a slope of ½. The slope determines the ratio of vertical to horizontal shift. In this case one part vertical gives two parts horizontal, so the corrected horizontal offset of −6 reflects a vertical misalignment of −3, with the negative or positive sign for the misalignment representing the direction of misalignment. Where the sensor movement speed and the sampling rate are known, the vertical misalignment of −3 corresponds directly to a misalignment distance which can be calculated and compensated for using known techniques such adjusting print timing or reformatting print data.

Figure 6:
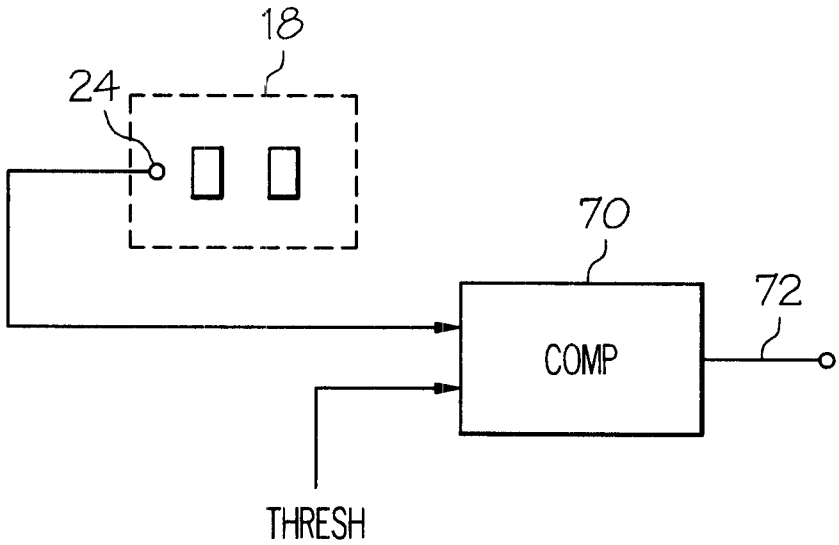
FIG. 6 is a schematic of another embodiment for sensor output signal analysis.

In another embodiment the edges of the blocks M and C can be determined by simply feeding the sensor output signal into a comparator circuit 70 as shown in FIG. 6. The comparator circuit 70 outputs one of a high signal and a low signal when the sensor output signal is above the threshold THRESH and outputs the other of the high signal and the low signal when the sensor output signal is below the threshold. The output of the comparator circuit 70 could then be sampled at a known sampling rate and the sample data points stored. Transitions from low to high and high to low from one sample data point to another sample sata point would then represent the block edges.

Although the invention has been described above in detail referencing the preferred embodiments thereof, it is recognized that various changes and modifications could be made without departing from the spirit and scope of the invention.

What is claimed is:

1. In a printer including first and second print heads mounted for movement across a paper path along a defined horizontal axis, a method for determining vertical misalignment between the print heads along a defined vertical axis which extends substantially perpendicular to the horizontal axis, the method comprising the steps of:

(a) printing a test pattern of first and second alternating slanted blocks extending horizontally across a media, the first and second slanted blocks slanted relative to both the horizontal axis and the vertical axis, each first slanted block printed by the first print head and each second slanted block printed by the second print head, a known edge angle of the first and second slanted blocks being substantially the same;

(b) moving a sensor horizontally over the test pattern and producing an output signal therefrom;

(c) identifying edges of each first slanted block and each second slanted block based upon the sensor output signal; and (d) determining vertical misalignment of the first and second print heads based upon the edges identified in step (c), the known edge angle, and a known horizontal misalignment of the first and second print heads.

2. The method of claim 1 wherein the sensor comprises a light sensor which outputs a varying amplitude signal according to an amount of light received.

3. The method of claim 1 wherein in step (b) the sensor is moved across the test pattern at a known, constant speed.

4. The method of claim 3 wherein step (c) involves inputting the sensor output signal to a comparator circuit and outputting one of a high signal and a low signal when the sensor output signal is below a threshold sense value and outputting the other of the high signal and the low signal when the sensor output signal is above the threshold sense value.

5. In a printer including first and second print heads mounted for movement across a paper path along a defined horizontal axis, a method for determining vertical misalignment between the print heads along a defined vertical axis which extends substantially perpendicular to the horizontal axis, the method comprising the steps of:

(a) printing a test pattern of first and second alternating slanted blocks extending horizontally across a media, the first slanted blocks printed by the first print head and the second slanted blocks printed by the second print head, a known edge angle of the first and second slanted blocks being substantially the same;

(b) moving a sensor horizontally over the test pattern and producing an output signal therefrom;

(c) identifying edges of the first slanted blocks and the second slanted blocks based upon the sensor output signal; and (d) determining vertical misalignment of the first and second print heads based upon the edges identified in step (c), the known edge angle, and a known horizontal misalignment of the first and second print heads;

wherein in step (b) the sensor is moved across the test pattern at a known, constant speed;

wherein step (c) involves sampling the sensor output signal at a known sampling rate, storing each sample in memory in association with a respective sample sequence number, and examining the stored samples for transitions across a threshold value, such transitions indicating edges of slanted blocks.

6. The method of claim 5 wherein:

step (d) involves determining a first center of a given first slanted block, determining a second center of an adjacent second slanted block, determining a third center of a next first slanted block, determining a first difference between the first center and the second center, determining a second difference between the second center and the third center, determining a third difference between the first difference and the second difference, and dividing the third difference by two to define a horizontal offset.

7. The method of claim 1 wherein the first print head prints first slanted blocks in mono and the second print head prints second slanted blocks in cyan.

8. The method of claim 1 wherein:

step (d) involves determining a first center of a given first slanted block, determining a second center of an adjacent second slanted block, determining a third center of a next first slanted block, determining a first difference between the first center and the second center, determining a second difference between the second center and the third center, determining a third difference between the first difference and the second difference, and dividing the third difference by two to define a horizontal offset.

9. In a printer including first and second print heads mounted for movement across a paper path along a defined horizontal axis, a method for determining misalignment between the print heads along a defined vertical axis which extends substantially perpendicular to the horizontal axis, the method comprising the steps of:

(a) printing a test pattern of a plurality of first slanted blocks and a plurality of second slanted blocks, the first slanted blocks and second slanted blocks slanted relative to both the horizontal axis and the vertical axis, the first slanted blocks and second slanted blocks alternating and the test pattern extending horizontally across a media, the first slanted blocks printed by the first print head and the second slanted blocks printed by the second print head, a known edge angle of the first and second slanted blocks being substantially the same;

(b) moving a sensor horizontally over the test pattern and producing an output signal therefrom;

(c) obtaining sample data points of the sensor output signal at a known sampling rate as the sensor moves at a known speed;

(d) calculating using the sample data points a first center of a given first slanted block, a second center of an adjacent second slanted block, and a third center of a next first slanted block;

(e) calculating a horizontal offset as a function of the first, second and third centers; and (f) determining vertical misalignment of the first and second print heads based upon the calculated horizontal offset of step (e), the known edge angle, and a known horizontal misalignment of the first and second print heads.

10. The method of claim 9 wherein the first print head prints first slanted blocks in mono and the second print head prints second slanted blocks in cyan.

11. The method of claim 10 wherein the known edge angle is defined relative to the horizontal axis and is about 26.6°.

12. The method of claim 9 wherein in step (d) the sample data points are compared to a threshold value which is substantially midway between a maximum and a minimum sensor output in order to identify block edges.

13. In a printer including first and second print heads mounted for movement across a paper path along a defined horizontal axis, a method for determining misalignment between the print heads along a defined vertical axis which extends substantially perpendicular to the horizontal axis, the method comprising the steps of:

(a) printing a test pattern of a plurality of first slanted blocks and a plurality of second slanted blocks, the first slanted blocks and second slanted blocks slanted relative to both the horizontal axis and the vertical axis, the first slanted blocks and second slanted blocks alternating and the test pattern extending horizontally, the first slanted blocks printed by the first print head and the second slanted blocks printed by the second print head, a known edge angle of the first and second slanted blocks being substantially the same;

(b) moving, at a known speed, a sensor horizontally over the test pattern and producing an output signal therefrom;

(c) determining vertical misalignment of the first and second print heads as a function of amplitude of the sensor output signal, the known speed, the known edge angle, and a known horizontal misalignment of the first and second print heads.

14. The method of claim 13 wherein:

step (c) involves:

(1) obtaining sample data points of the sensor output signal at a known sampling rate;

(2) calculating using the sample data points a first center of a given first slanted block, a second center of an adjacent second slanted block, and a third center of a next first slanted block;

(3) calculating a horizontal offset as a function of the first, second and third centers.

15. The method of claim 13 wherein the first print head prints first slanted blocks in mono and the second print head prints second slanted blocks in cyan.

16. The method of claim 13 wherein the known edge angle is defined relative to the horizontal axis and is in about 26.6°.

17. The method of claim 13 wherein:

step (c) involves inputting the sensor output signal to a comparator circuit and outputting one of a high signal and a low signal when the sensor output signal is below the threshold sense value and outputting the other of the high signal and the low signal when the sensor output signal is above the threshold sense value.

* * * * *